US009654863B2

(12) United States Patent
Crosby et al.

(10) Patent No.: US 9,654,863 B2
(45) Date of Patent: May 16, 2017

(54) MAIN LOGIC BOARD WITH MOUNTED SPEAKER AND INTEGRATED ACOUSTIC CAVITY

(71) Applicant: Apple Inc., Cupertino, CA (US)

(72) Inventors: Justin D Crosby, Cupertino, CA (US); Matthew A Donarski, San Jose, CA (US); Andrew P Bright, San Francisco, CA (US); Joss N Giddings, San Francisco, CA (US); Ron A Hopkinson, Campbell, CA (US); Nathan A Johanningsmeier, San Jose, CA (US); William F Leggett, San Jose, CA (US); Mikael M Silvanto, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 138 days.

(21) Appl. No.: 14/563,990

(22) Filed: Dec. 8, 2014

(65) Prior Publication Data

US 2016/0165327 A1 Jun. 9, 2016

(51) Int. Cl.
*H04R 1/02* (2006.01)
*H04R 1/28* (2006.01)

(52) U.S. Cl.
CPC ..... *H04R 1/2811* (2013.01); *H04R 1/288* (2013.01); *H04R 2499/15* (2013.01)

(58) Field of Classification Search
CPC ..... H04R 1/2811
USPC ..... 381/386, 332
See application file for complete search history.

(56) References Cited

U.S. PATENT DOCUMENTS

| | | | | |
|---|---|---|---|---|
| 7,565,178 | B1 | 7/2009 | Sitachitt et al. | |
| 8,126,138 | B2 | 2/2012 | Dinh et al. | |
| 8,891,802 | B2 * | 11/2014 | Infanti | H04R 1/2811 381/386 |
| 2009/0274336 | A1 | 11/2009 | Infanti | |
| 2013/0177185 | A1 | 7/2013 | Takahashi et al. | |

FOREIGN PATENT DOCUMENTS

| | | | |
|---|---|---|---|
| GB | 2 408 404 | A | 5/2005 |

* cited by examiner

*Primary Examiner* — William Deane, Jr.
(74) *Attorney, Agent, or Firm* — Blakely, Sokoloff, Taylor & Zafman LLP

(57) ABSTRACT

A computer system having a loudspeaker mounted on a main logic board by a hermetic seal, is disclosed. More particularly, embodiments of the computer system include an acoustic cavity defined between the loudspeaker, the main logic board, and the hermetic seal. Embodiments of the computer system may include a compressible seal separated from the hermetic seal by the loudspeaker and/or the main logic board. The compressible seal may define an acoustic channel and the loudspeaker may emit sound in a high frequency range through the acoustic channel toward a system exit. Other embodiments are also described and claimed.

20 Claims, 11 Drawing Sheets

B - B

A - A

D - D

A - A

E - E

MAIN LOGIC BOARD WITH MOUNTED SPEAKER AND INTEGRATED ACOUSTIC CAVITY

BACKGROUND

Field

Embodiments related to an electronics device having a loudspeaker mounted on a main logic board are disclosed. More particularly, an embodiment related to a computer system having a loudspeaker bonded to a main logic board by a hermetic seal that partially defines an integrated acoustic cavity is disclosed.

Background Information

A portable consumer electronics device, such as a laptop computer, typically includes a system enclosure surrounding internal system components and devices. The internal system components generally include a primary circuit board, e.g., a motherboard, and one or more audio speakers for outputting audio. These internal system components must share the limited space within the system enclosure. Furthermore, the motherboard generally includes many layers of components, including integrated circuits, passive devices, etc., which crowd the spaces above and below the motherboard. Thus, the audio speakers have ordinarily been located to a side of the motherboard so that the speaker can be as tall as the entire vertical space within the system enclosure, rather than sharing the vertical space with the motherboard. This can allow more of the vertical space to be used for both the speaker driver and the back volume of the audio speaker to thereby provide desirable low frequency audio output.

SUMMARY

Portable consumer electronics devices, such as laptop computers, have continued to become more and more compact. As system enclosures become smaller, the space available for speaker integration to a side of a primary circuit board, also referred to here as a main logic board, diminishes. As described below, rather than occupying a space lateral to the main logic board, system speakers may be moved onto the main logic board. For example, one or more of the speakers, such as a high frequency restricted "tweeter" device, may be mounted on the main logic board to occupy or share the same vertical space within the system enclosure as the main logic board. However, a speaker requires adequate back volume to produce acceptable sound quality within a designed—for audio range. Thus, computer systems are disclosed that mount a loudspeaker to the main logic board such that a back volume is integrated between the loudspeaker and the main logic board to generate an additional volume.

A computer system may include a system housing having a top case with an integrated opening, as well as a bottom case. A main logic board within the system housing may be located below the top case (and above the bottom case), and may include a circuit carrier or a substrate to which are coupled one or more electronic components, e.g., a processor and/or a memory. In an embodiment, a loudspeaker is attached to the main logic board by a hermetic seal. The loudspeaker may be an electrodynamic driver, and thus, may have a diaphragm that is movably connected with a speaker housing or frame to emit sound toward the opening in the top case. For example, the loudspeaker may be a tweeter configured to emit sound in a range higher than 1,500 Hz. The speaker housing or frame may be coupled with the substrate by the hermetic seal such that an acoustic cavity is defined between the diaphragm, the speaker housing, the hermetic seal, and the substrate. For example, the hermetic seal may include a solder joint or an adhesive joint that attaches the speaker housing to the substrate along a closed path surrounding the acoustic cavity.

In an embodiment, the speaker housing is shaped to form the acoustic cavity such that an additional volume and thus a low frequency output is obtained. For example, the speaker housing may include a first edge to which the diaphragm is movably connected at a first location and a second edge connected with the substrate by the hermetic seal at a second location radially outward from the first location. That is, the speaker housing may have a bell-shape, with a predetermined volume to achieve an intended acoustic response.

The computer system having an acoustic cavity integrated within the hermetic seal between the loudspeaker and the main logic board may also include a compressible seal between the loudspeaker and the top case of the system housing to direct the emitted sound toward the opening. For example, the compressible seal may define an acoustic channel extending between the diaphragm and the opening such that sound can more efficiently radiate outside the system housing into a surrounding environment, rather than leak into a lateral space within the system housing. For example, in an embodiment, the compressible seal extends from the circuit carrier or substrate to the top case. In another embodiment, the compressible seal extends only from a top surface of the speaker housing to the top case. Thus, the speaker housing may separate the compressible seal from the hermetic seal such that the respective seals define different volumes in the speaker assembly, e.g., a front volume and a back volume of the speaker assembly.

In an embodiment, the computer system includes a through hole or port formed through the substrate that is radially positioned inward from the hermetic seal. The opening through the top case may have a first cumulative cross-sectional area, and the port may have a second cumulative cross-sectional area, and together these may be sized to provide the desired acoustic effects. For example, the second cumulative cross-sectional area of the port or substrate opening could be sized such that acoustic resistance is provided to the driver to mitigate acoustic resonances.

A back casing may be located below the port to form a second chamber of a multi-chamber back volume of the speaker assembly. For example, the back casing may be mounted on an underside of the substrate such that a casing cavity is defined between the back casing and the substrate, between the main logic board and bottom case. Thus, the acoustic cavity defined between the diaphragm, the speaker housing, the hermetic seal, and the substrate may be acoustically coupled with the casing cavity through the port. Accordingly, the speaker assembly has a multi-chambered back volume that includes the acoustic cavity or chamber above the substrate and the casing cavity below the substrate. The multi-chamber back volume may provide a desirable low frequency output.

In an embodiment, the loudspeaker includes a magnetic structure as part of a motor assembly to drive the diaphragm. For example, the magnetic structure may include a stack having a top plate, a permanent magnet, and a yoke. The magnetic structure may be located above the substrate and inside of the acoustic cavity. A channel may extend through the stack of the magnetic structure from the acoustic cavity to the port in order to place the acoustic cavity in fluid (acoustic) communication with the casing cavity. The back casing that provides the audio intended casing cavity may also be configured to passively shield an electronic component. For example, the electronic device may be mounted on the substrate in the casing cavity, and the back casing may surround the electronic device to acoustically and/or electrically (electromagnetically) shield the electronic device from interference. Accordingly, a multi-chamber back volume may reduce system noise and boost system performance by shielding main logic board components, such as components that emit noise directly. Furthermore, if system noise arises from substrate vibration, the substrate that forms a portion of the multi-chamber back volume may be stiffened to augment the noise reduction.

In an embodiment, the loudspeaker is integrated directly with the main logic board. For example, the diaphragm may be movably connected with the substrate directly, such that a surround of the loudspeaker is directly attached to the substrate (rather than to the loudspeaker housing/frame). In that case, the speaker housing may be attached to the lower face of the substrate at the hermetic seal radially outward from the inner edge. Accordingly, sound may be emitted upward toward the opening in the top case, and a back volume may be defined opposite from the opening by the combination of the diaphragm, the substrate, and the speaker housing.

In another embodiment, the speaker assembly may include a multi-chamber front volume. For example, a front volume of the loudspeaker may include an acoustic channel above the substrate and an acoustic cavity below the substrate. More particularly, the speaker housing may be mounted on an underside or lower face of the substrate (extending downward from the underside, as opposed to upward from the top side or upper face), and the diaphragm may be located within the speaker housing below the substrate, such that an acoustic cavity is formed between the diaphragm, the speaker housing, and the underside of the substrate. The port through the substrate may interconnect the acoustic cavity with the acoustic channel above the substrate to form a multi-chamber front volume.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
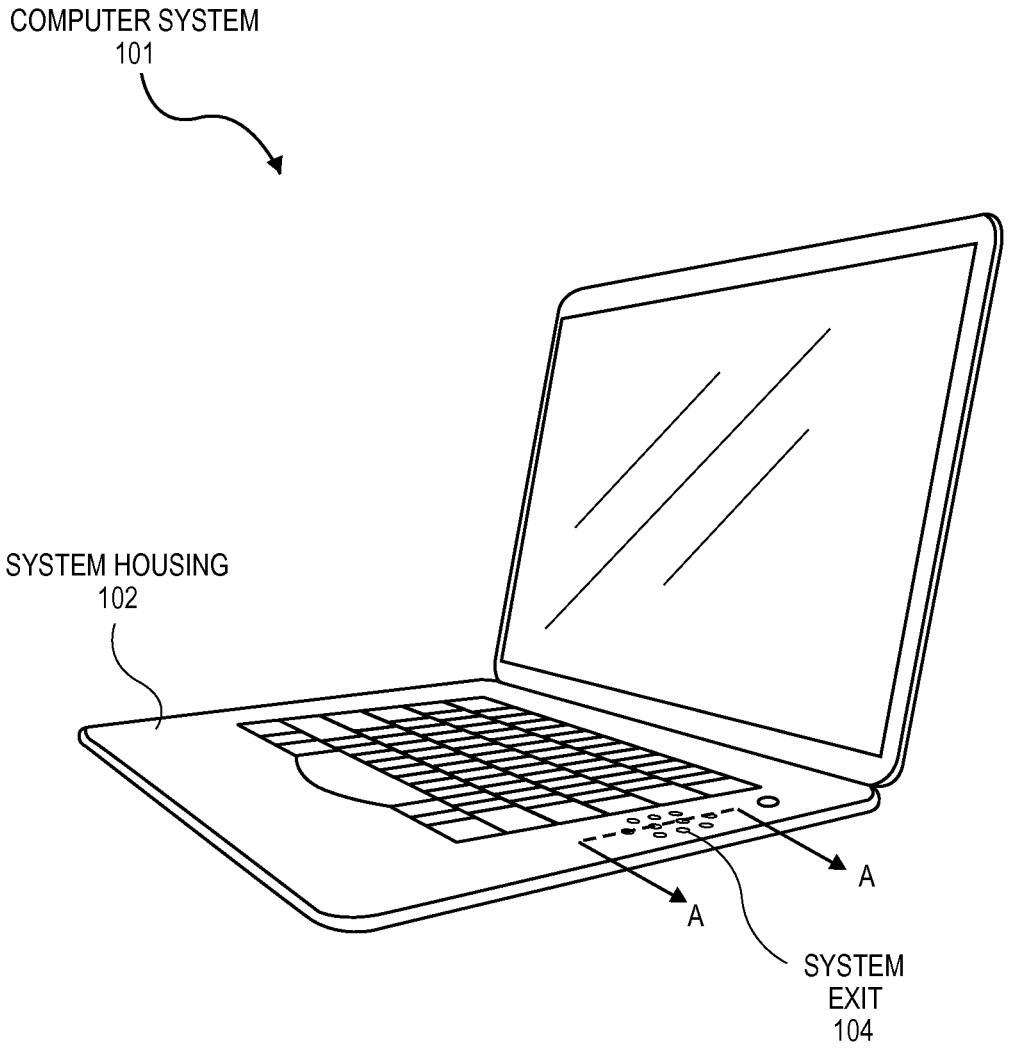
FIG. 1 is a perspective view of a computer system.

Embodiments describe computer systems having a loudspeaker mounted on a main logic board by a hermetic seal. However, while some embodiments are described with specific regard to integration within laptop computer systems, the embodiments are not so limited and certain embodiments may also be applicable to other uses. For example, a speaker assembly as described below may be incorporated into other devices and apparatuses having printed circuit boards and electroacoustic transducers, including desktop computers and portable consumer electronics devices (such as smartphones and tablet computers), to name only a few possible applications.

In various embodiments, description is made with reference to the figures. However, certain embodiments may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment", or the like, means that a particular feature, structure, configuration, or characteristic described is included in at least one embodiment. Thus, the appearance of the phrase "one embodiment," "an embodiment", or the like, in various places throughout this specification are not necessarily referring to the same embodiment. Furthermore, the particular features, structures, configurations, or characteristics may be combined in any suitable manner in one or more embodiments.

The use of relative terms throughout the description, such as "top" and "bottom" may denote a relative position or direction. For example, a "top case" may be located in a first axial direction from an internal component of a computer system and a "bottom case" may be directed in a second axial direction opposite to the first axial direction. However, such terms are not intended to limit the use of the computer system to a specific configuration described in the various embodiments below. For example, a top case of a computer system may be oriented in a direction parallel to the ground from a loudspeaker in certain applications, such as in the case of a front panel of an automated teller machine.

In an aspect, a loudspeaker may be mounted directly on a main logic board such that at least a portion of an acoustic cavity, e.g., a back volume, is defined between the loudspeaker and the main logic board. The loudspeaker may be mounted on the main logic board by hermetically sealing a speaker housing directly to a substrate of the main logic board, e.g., using solder or adhesive. Thus, the acoustic cavity may be partly defined by a closed path of the hermetic seal. The integrated acoustic cavity may enhance audio output, and in an embodiment, sound quality may be further enhanced by providing a compressible seal separate from the hermetic seal. For example, the compressible seal may define an acoustic output channel in a front volume for sound to be directed through openings in the top case toward a surrounding environment.

In an aspect, a back volume of a loudspeaker mounted directly on a main logic board may be increased by providing a port through the main logic board from an acoustic cavity over the main logic board to a rear cavity under the main logic board. In an embodiment, a back casing may be hermetically sealed to an underside of the main logic board to create the rear cavity. Thus, the port may acoustically couple a first chamber of a speaker volume above the main logic board with a second chamber of the speaker volume below the main logic board. As such, the chambers may combine to form a back volume of a speaker assembly.

In an aspect, a loudspeaker may be mounted directly on a main logic board such that sound is emitted toward the main logic board. For example, a top surface of the loudspeaker may be hermetically sealed to a bottom surface of the main logic board. Thus, an acoustic cavity may be partly defined by a closed path of the hermetic seal in front of a speaker diaphragm. That is, the acoustic cavity may be located between the loudspeaker and an underside of the main logic board. In an embodiment, a port through the main logic board may allow sound to propagate upward toward a top case of a system enclosure. Furthermore, a compressible seal may extend from an upper side of the main logic board to the top case to form an acoustic channel to direct the sound through openings in the top case toward a surrounding environment. As such, the acoustic channel and the acoustic cavity may combine to form multiple chambers of a front volume of a speaker assembly.

Referring to FIG. 1, a perspective view of a computer system is shown. A computer system 101, such as a laptop computer, may include a speaker assembly as described below. More particularly, any computer system 101 having a system housing 102 that encloses a loudspeaker and a primary circuit board, such as a main logic board, may include an embodiment of a speaker assembly. Thus, although computer system 101 may be a laptop computer, it may also be a tablet computer, a mobile phone, etc. In any case, computer system 101 may include a system exit 104, such as a perforation or slots in a keyboard, through which the internal loudspeaker may radiate sound into a surrounding environment.

Figure 2:
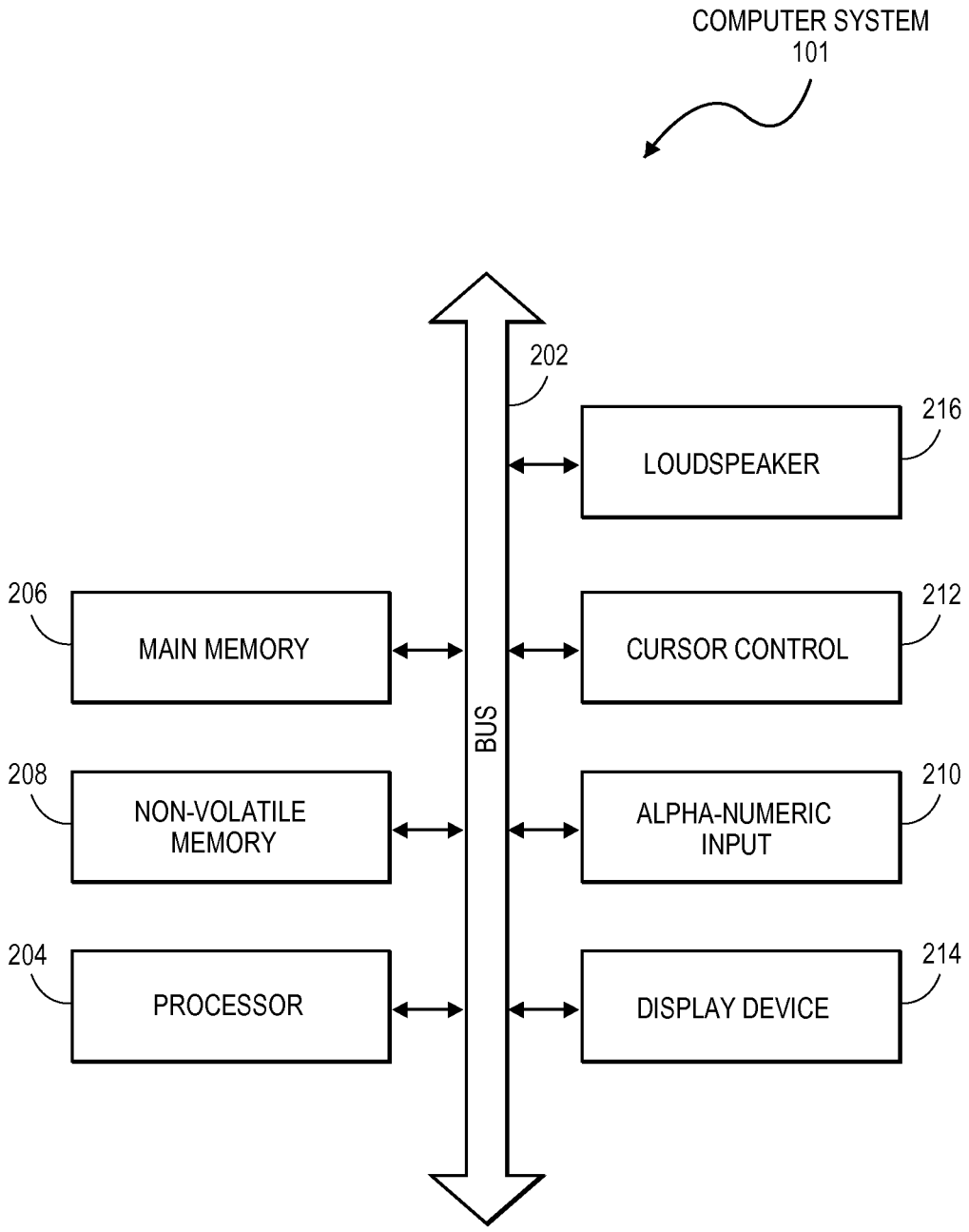
FIG. 2 is a block diagram of electronic components in a computer system.

Referring to FIG. 2, a block diagram of electronic components in a computer system is shown. Computer system 101 is exemplary, and embodiments of the invention may operate on, or be controlled by, a number of different computer systems including general purpose networked computer systems, embedded computer systems, routers, switches, server devices, client devices, various intermediate devices/nodes, stand-alone computer systems, and the like. In an embodiment, computer system 101 includes an address/data bus 202 for communicating information. For example, computer system 101 may include a main logic board having a processor 204, e.g., a central processing unit, coupled to bus 202 for processing information and instructions. The main logic board of computer system 101 may also include data storage features such as a main memory 206, e.g., a computer usable volatile memory such as dynamic random access memory (DRAM), coupled to bus 202 for storing information and instructions for central processing unit 204. Computer usable non-volatile memory 208, e.g. read only memory (ROM), may also be coupled to bus 202 and/or mounted on the main logic board for storing static information and instructions for the central processor 204. In addition to processing and memory hardware, computer system 101 may include various input and output devices. For example, computer system 101 may include an alphanumeric input device 210 and/or cursor control device 212 coupled to bus 202 for communicating user input information and command selections to central processing unit 204. Likewise, computer system 101 may include a display device 214 coupled to bus 202 for displaying information to a user. In an embodiment, one or more of the input and output devices may be directly mounted on the main logic board. For example, a loudspeaker 216 may be electrically connected to the main logic board and coupled to bus 202, for receiving an audio signal and in response generating and emitting sound through system exit 104 toward the user.

Figure 3:
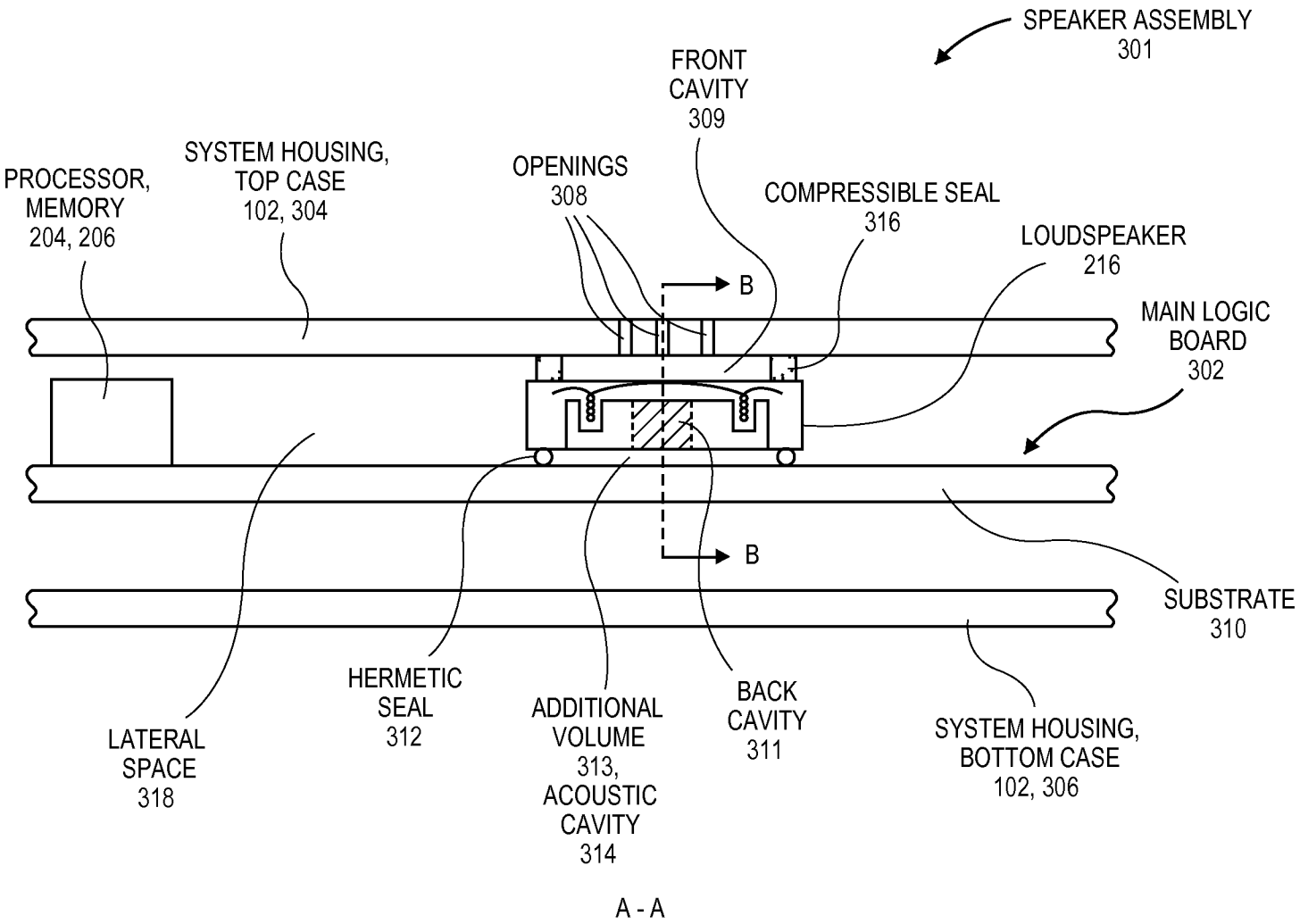
FIG. 3 is a cross-sectional view, taken about line A-A of FIG. 1, of a speaker assembly of a computer system in accordance with an embodiment of the invention.

Referring to FIG. 3, a cross-sectional view, taken about line A-A of FIG. 1, of a speaker assembly of a computer system is shown in accordance with an embodiment of the invention. Computer system 101 may include a speaker assembly 301 to generate and output sound to a user. In an embodiment, speaker assembly 301 includes loudspeaker 216, and in addition, speaker assembly 301 includes one or more acoustic cavities formed by portions of a system housing 102 and a main logic board 302. In an embodiment, system housing 102 is a rigid enclosure, e.g., formed from aluminum, and includes a top case 304 and a bottom case 306 creating an internal space within which loudspeaker 216 and main logic board 302 are housed. Each case, i.e., top case 304 and bottom case 306 may form an envelope of system housing 102. For example, top case 304 may be a ceiling to, and provide a top face for, a volume within system housing 102. Similarly, bottom case 306 may be a floor to, and provide a bottom face for, the volume within system housing 102. Main logic board 302 may include a printed circuit board, e.g., a motherboard, having a substrate 310 with one or more layers, e.g., laminated conductive layers separated by non-conductive layers and patterned to form circuit traces that make electrical signal connections between various components that are installed on the substrate 310, e.g., processor 204, main memory 206, audio amplifiers, etc. Speaker assembly 301 may include portions of top case 304 and bottom case 306 above and below loudspeaker 216. In particular, speaker assembly 301 may include a portion of top case 304 having one or more openings 308 for porting sound generated by loudspeaker 216 to the surrounding environment. A back volume of loudspeaker 216 may be integrated between loudspeaker 216 and substrate 310 of main logic board 302. For example, loudspeaker 216 may be connected to and/or sealed against substrate 310 of main logic board 302 by a hermetic seal 312. Thus, a back cavity 311 and an additional volume 313, which includes an acoustic cavity 314, may define all or part of a speaker back volume. For example, back cavity 311 may include a volume within loudspeaker 216, below a diaphragm of loudspeaker 216. Thus, the back volume may be enclosed between loudspeaker 216, hermetic seal 312, and a top surface of substrate 310.

In an embodiment, a front volume may be enclosed above loudspeaker 216 by a compressible seal 316 that extends between loudspeaker 216 and a bottom surface of top case 304, i.e., a ceiling or top face of the volume within system housing 102. Thus, sound generated by loudspeaker 216 may be directed through a front cavity 309 portion of the front volume toward openings 308 and into the surrounding environment without propagating into a lateral space 318 within system housing 102. In an embodiment, other system components and devices such as processor 204 and/or main memory 206 may be mounted on main logic board 302 within lateral space 318. The other system components may be on the same side as loudspeaker 216, as shown. Alternatively, the other system components may be on an opposite side of main logic board 302, e.g., between substrate 310 and a top surface of bottom case 306, i.e., a floor to or a bottom face of the volume within system housing 102.

Figure 4:
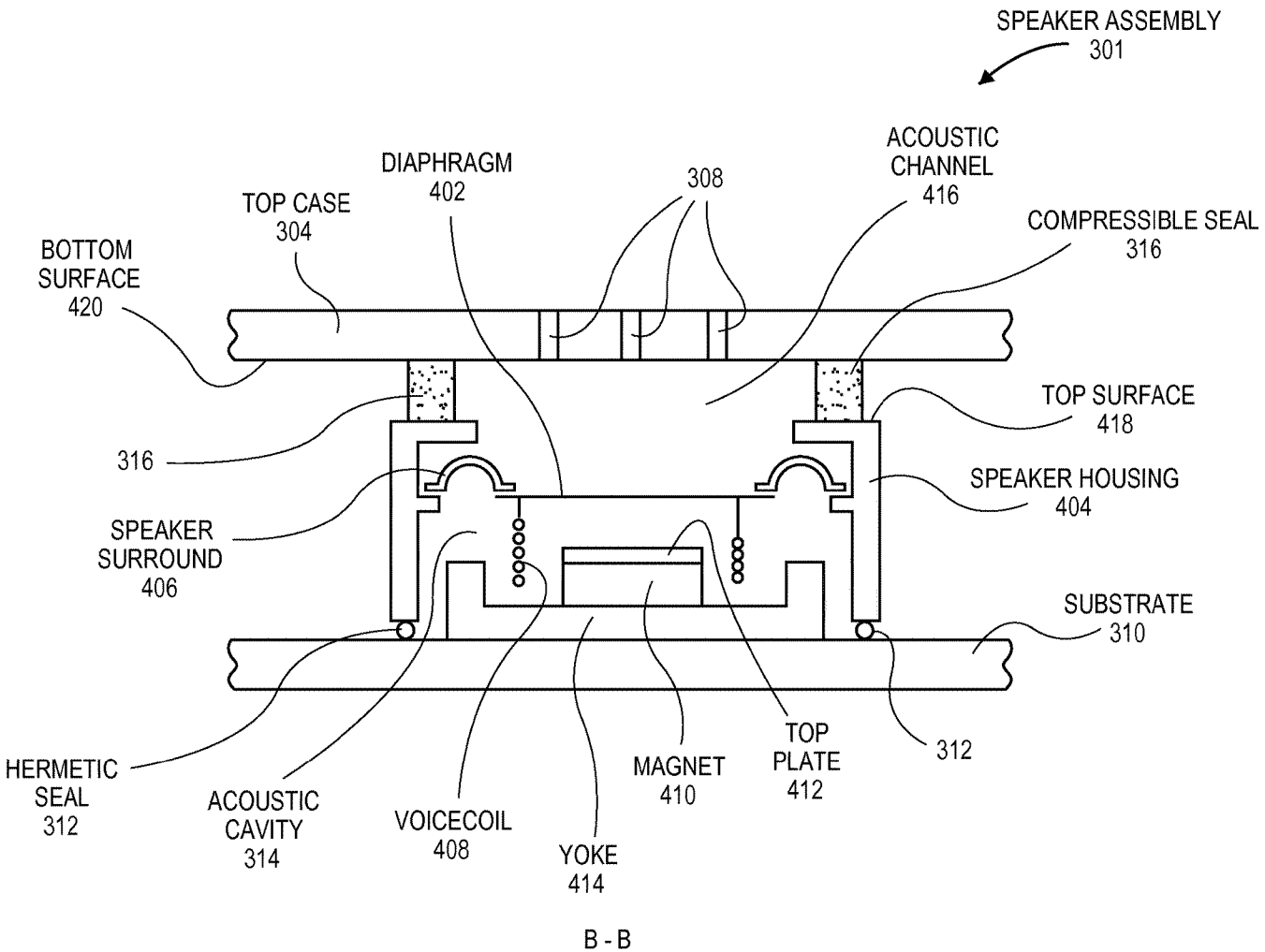
FIG. 4 is a cross-sectional view, taken about line B-B of FIG. 3, of a loudspeaker mounted on a main logic board in accordance with an embodiment.

Referring to FIG. 4, a cross-sectional view, taken about line B-B of FIG. 3, of a loudspeaker mounted on a main logic board is shown in accordance with an embodiment. In an embodiment, speaker assembly 301 includes loudspeaker 216 sandwiched between top case 304 of system housing 102 and substrate 310 of main logic board 302. Loudspeaker 216 may be an electroacoustic transducer designed to reproduce sound in a predetermined audio frequency range. For example, loudspeaker 216 may be a high frequency driver, i.e., a "tweeter". The tweeter may be configured to emit sound having an audio frequency in a range higher than 1,500 Hz. For example, loudspeaker 216 may generate sounds having an audio frequency in a range higher than 2,000 Hz. Alternatively, loudspeaker 216 may have another driver design, e.g., loudspeaker 216 may be a mid-range driver capable of reproducing sound in a range of 300 to 5,000 Hz. Although the profile dimensions (X,Y) of loudspeaker 216 may vary based on a particular application, in a laptop integration scenario, loudspeaker 216 may have profile dimensions X,Y (when viewed axially in a direction perpendicular to a diaphragm 402—see FIG. 6B) on the order of 30 mm by 30 mm, and in another case on the order of 10 mm by 10 mm. Furthermore, a profile shape of loudspeaker 216 (when viewed in the direction of sound emission) may include any geometry, including circular or rectangular geometries—see FIGS. 6A-6C.

Loudspeaker 216 may include diaphragm 402 surrounded by a speaker housing 404. More particularly, diaphragm 402 may be movably connected to speaker housing 404 by a speaker surround 406 that flexes to allow diaphragm 402 to move axially with pistonic motion, i.e., forward and backward, relative to speaker housing 404. The pistonic motion may be imparted to diaphragm 402 by a motor assembly to reproduce a desired sound. For example, diaphragm 402 may be connected to a voicecoil 408 that moves relative to a magnetic structure of the motor assembly. In an embodiment, the magnetic structure includes a stack of magnetic components. For example, a magnet 410 may be attached to a top plate 412 at a front face and to a yoke 414 at a back face. Magnet 410 may include a permanent magnet and both top plate 412 and yoke 414 may be formed from magnetic materials to create a magnetic circuit having a magnetic gap within which voicecoil 408 may oscillate forward and backward. Thus, when an electrical audio input signal is input to voicecoil 408, a mechanical force may be generated that moves diaphragm 402 relative to the stack of magnetic components to radiate sound forward into a front volume of speaker assembly 301 and through openings 308 into the surrounding environment.

In an embodiment, loudspeaker 216 is mounted directly on substrate 310. For example, speaker housing 404 may be connected to substrate 310 by hermetic seal 312. Hermetic seal 312 may be formed by bonding speaker housing 404 to substrate 310 using known techniques, such as surface-mount technology. In an embodiment, hermetic seal 312 may run along a lower edge of a wall or face of speaker housing 404 that surrounds a driver, i.e., motor assembly, of loudspeaker 216. Hermetic seal 312 may extend axially between the wall or face of speaker housing 404 and substrate 310. Accordingly, loudspeaker 216 may be mounted directly on substrate 310 by using reflow techniques to deposit solder or high temperature plastics to form an airtight joint at hermetic seal 312 between speaker housing 404 and substrate 310. The joint may mechanically secure speaker housing 404 to substrate 310, and may also provide an electrical connection between the motor assembly of loudspeaker 216 and bus 202. For example, a conductive solder may form a portion of an electrical connection between voicecoil 408 and bus 202. So the hermetic seal 312 need not be completely surrounding the diaphragm 402; if conductive, it may form two isolated sections to deliver the audio signal to the voicecoil 408 and return the signal back to the amplifier. For example, the two isolated sections may be two semi-circular seals, e.g., c-shaped seals with the ends of each seal adjacent to a corresponding end of the other seal. Accordingly, the c-shaped seals may be a conductive solder while the gaps between the c-shaped seals may be filled by a non-conductive sealant, e.g., an adhesive, to form a composite circular seal.

In an alternative embodiment, hermetic seal 312 may be formed by applying and curing an adhesive, e.g., an epoxy resin, between speaker housing 404 and substrate 310. The cured epoxy may fasten loudspeaker 216 directly to main logic board 302. Furthermore, electrical connections between the voicecoil 408 of the loudspeaker 216 and an audio amplifier on the main logic board 302 (not shown) may be formed using, e.g., pins or leads in the speaker housing, which may go through hermetic seal 312 or down through a lower metal trace/conductive layer of the substrate 310. For example, in an embodiment, through-hole construction may be used, in which pins providing electrical connections to the motor assembly of speaker assembly 301 may be inserted in and soldered to, substrate 310. An adhesive may be flowed into the remaining gaps around the pins and between speaker housing 404 and substrate 310 to create hermetic seal 312. Hermetic seal 312 may be formed such that the electrical pins are encapsulated within an epoxy, for example. Thus, hermetic seal 312 may traverse a path that includes airtight portions and/or electrical connections.

Loudspeaker 216 may be mechanically and/or electrically connected with main logic board 302 using other known techniques. For example, speaker housing 404 may be secured to substrate 310 at one or more locations by mechanical connectors, such as threaded fasteners, rivets, etc. Electrical connections between voicecoil 408 and bus 202 may be formed by leads, vias, and other known electrical connectors. Thus, while hermetic seal 312 may provide a mechanical and/or electrical connection between loudspeaker 216 and main logic board 302, other connectors may supplement such connections.

In an embodiment, the integration of a speaker back volume between loudspeaker 216 and substrate 310 and the creation of electrical connections between loudspeaker 216 and main logic board 302 may be performed in multiple operations. For example, hermetic seal 312 may be formed in a first operation, e.g., by reflowing solder along a closed path between speaker housing 404 and substrate 310. Loudspeaker 216 may be electrically connected to bus 202 (or to another electronic component) in a second operation, e.g., by soldering one or more pins of loudspeaker 216 to substrate 310 and/or connecting electrical leads between the two components. In an embodiment, the sealing operation forms an airtight joint along a closed path to form an integrated back volume between loudspeaker 216 and substrate 310, and to prevent air leakage from the back volume behind the diaphragm 402 to lateral space 318 in the system housing 102 (except for an intentional vent—not shown—that may be added to provide a small air leak so that internal and external pressures can equalize over time to compensate for barometric pressure or altitude changes; an imperfectly sealed enclosure may also be sufficient to provide this slow pressure equalization). For example, hermetic seal 312 may extend around a perimeter of a bottom surface of speaker housing 404 to create acoustic cavity 314. More particularly, acoustic cavity 314 may be defined between diaphragm 402, surround 406, speaker housing 404, substrate 310, and motor assembly. Thus, in an embodiment, acoustic cavity 314 provides an entire back volume of speaker assembly 301.

A front volume of speaker assembly 301 may be provided above diaphragm 402. As diaphragm 402 moves up and down during sound reproduction, sound may travel upward into the front volume, which may be defined between diaphragm 402, surround 406, speaker housing 404, compressible seal 316, and top case 304. More particularly, sound may travel upward toward top case 304 through an acoustic channel 416 portion of the front volume. In an embodiment, acoustic channel 416 is that portion of the front volume that is radially inward from compressible seal 316. For example, compressible seal 316 may be a gasket that fills a gap between a top surface 418 of speaker housing 404 and a bottom surface 420 of top case 304. For example, compressible seal 316 may run along an upper edge of a wall or face of speaker housing 404 radially outward from diaphragm 402. Compressible seal 316 may extend axially between the wall or face, e.g., top surface 418, and ceiling or top face of the system housing, e.g., bottom surface 420. Thus, compressible seal 316 may be separated from hermetic seal 312 by speaker housing 404. The gasket may be annular, e.g., cylindrical, creating a cylindrical acoustic channel 416 through which sound propagates on the way from diaphragm 402 to the surrounding environment. It could alternatively have a different annular shape, e.g., elliptical, polygonal, or a combination having some curved portions and some straight portions (see, e.g., FIGS. 6A-6C). In an embodiment, compressible seal 316 is formed from an acoustically rigid material, such as a polyurethane foam, that directs sound forward to openings 308 and/or prevents sound from leaking radially outward from acoustic channel 416 to lateral space 318 within system housing 102. Thus, in an embodiment, an outer boundary of speaker assembly 301 encompasses a front volume and a back volume defined between top case 304, compressible seal 316, speaker housing 404, hermetic seal 312, and substrate 310.

Figure 5:
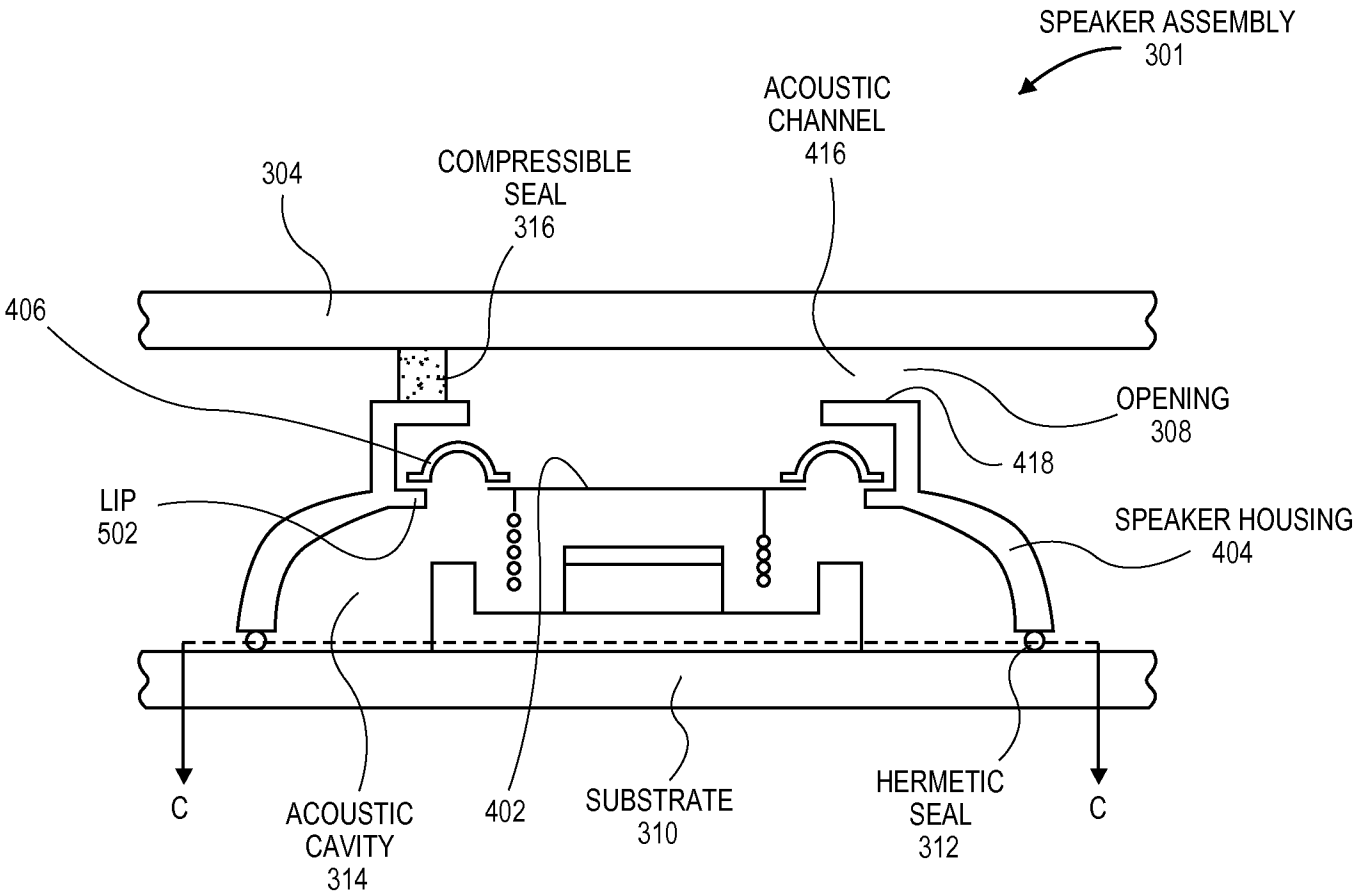
FIG. 5 is a cross-sectional view, taken about line B-B of FIG. 3, of a loudspeaker mounted on a main logic board in accordance with an embodiment.

Referring to FIG. 5, a cross-sectional view, taken about line B-B of FIG. 3, of a loudspeaker mounted on a main logic board is shown in accordance with an embodiment. The geometry of the front volume and back volume of speaker assembly 301 may be altered by changing the geometry of those portions of speaker assembly 301 that define the volumes. For example, speaker housing 404 may be designed to provide a predetermined back volume size for obtaining a desired acoustic response. More particularly, speaker housing 404 walls below diaphragm 402 may be shaped to control the dimensions of acoustic cavity 314. In an embodiment, speaker housing 404 walls may be flared outward (like a bell shape as shown) to enlarge acoustic cavity 314 as compared to the embodiment shown in FIG. 4. For example, speaker housing 404 may be bonded to speaker surround 406 at a first location on an edge or surface of a lip 502 feature. Furthermore, speaker housing 404 may be bonded to substrate 310 by hermetic seal 312 at a second location, which may be radially outward from the first location. As such, the walls of speaker housing 404 may form a concave upward shape that defines a portion of acoustic cavity 314. In particular, the bell-shaped acoustic cavity 314 may have a volume that enhances sound quality of loudspeaker 216 as compared to, e.g., a cylindrical acoustic cavity 314 with a radius defined by the first location at lip 502.

Other embodiments of speaker housing 404 may provide for different sizes of an integrated back volume between speaker housing 404 and substrate 310. For example, rather than being tapered toward substrate 310 from lip 502, speaker housing 404 may extend radially outward from speaker surround 406 at lip 502 in a direction parallel to substrate 310. Then, at a location radially outward from speaker surround 406, speaker housing 404 may angle downward, e.g., in a tapered manner or perpendicular to substrate 310. Thus, speaker housing 404 may be sealed against substrate 310 by hermetic seal 312 radially outward from diaphragm 402. In such case, speaker housing 404 may form a cylindrical cavity below diaphragm 402 and the cavity may have a diameter larger than that of diaphragm 402 to create a back volume that produces a desired low frequency output.

Still referring to FIG. 5, the front volume of speaker assembly 301 may also be tailored by adjusting the components that define portions of the volume, e.g., acoustic channel 416. In an embodiment, compressible seal 316 may have a non-annular shape that allows sound to propagate through a side-firing opening 308. For example, rather than being ring-shaped, compressible seal 316 may have a c-shaped profile, such that sound can propagate sideways through the discontinuity in the c-shape. Thus, in an embodiment, the break in the c-shape of compressible seal 316 is aligned with opening 308 directed toward a side-firing port in system housing 102, e.g., a perforation in a side panel rather than in top case 304, such that when diaphragm 402 emits sound upward toward top case 304, the sound is redirected through acoustic channel 416 of front volume into side-firing opening 308 and radially outward to the surrounding environment.

In an embodiment, a side-firing speaker design includes an annular compressible seal 316 that seals entirely around a top surface 418 of speaker housing 404. In such case, a hole may be formed radially through a wall of speaker housing 404 above diaphragm 402 to allow for sound to be emitted laterally. Thus, the example of a side-firing speaker assembly 301 illustrated in FIG. 5 is provided by way of example only, and not by way of limitation.

Figure 6A:
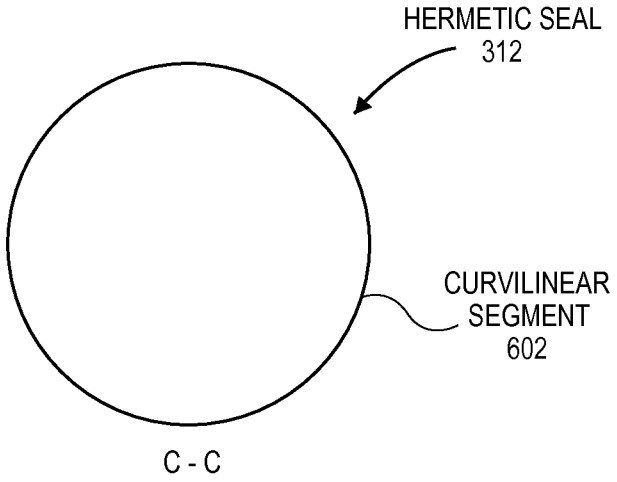
FIGS. 6A-6C are cross-sectional views, taken about line C-C of FIG. 5, of a hermetic seal between a loudspeaker and a main logic board in accordance with an embodiment.

Referring now to FIG. 6A, a cross-sectional view, taken about line C-C of FIG. 5, of a hermetic seal between a loudspeaker and a main logic board is shown in accordance with an embodiment. Similar to the manner in which speaker housing 404 and compressible seal 316 may be modified to adjust a back volume and/or front volume of speaker assembly 301, the contour of hermetic seal 312 may also be altered to control the volume of acoustic cavity 314. In an embodiment, hermetic seal 312 extends along a closed path within a plane between speaker housing 404 and substrate 310. Thus, hermetic seal 312 encloses a portion of acoustic cavity 314 that may be defined radially inward from hermetic seal 312. Accordingly, the defined volume may depend on the cross-sectional area and the thickness of hermetic seal 312.

For example, hermetic seal 312 may extend along a curvilinear path having one or more curvilinear segments 602. The curvilinear path may be circular and have a thickness that defines a cylindrical portion of acoustic cavity 314. Accordingly, by altering a diameter of curvilinear segment 602, or by altering the thickness of hermetic seal 312, the volume of acoustic cavity 314 enclosed by hermetic seal 312 may be controlled. In an embodiment, the thickness of hermetic seal 312 is in a range on the order of less than 10 mm, and in some cases less than 1 mm.

Figure 6B:
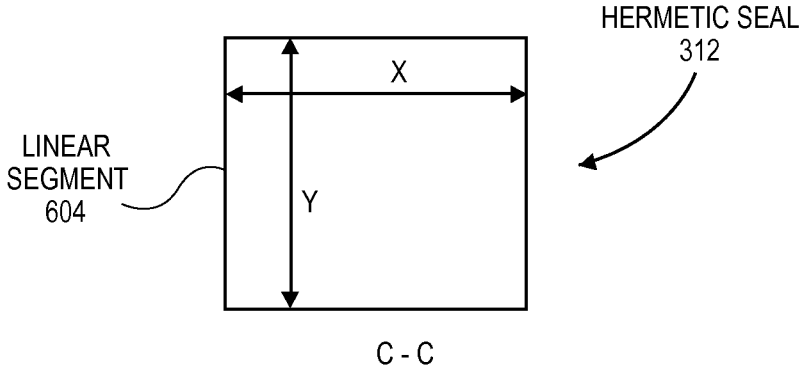

FIG. 6B illustrates a cross-sectional view, taken about line C-C of FIG. 5, of a hermetic seal between a loudspeaker and a main logic board in accordance with an embodiment. In an embodiment, hermetic seal 312 extends along a closed path that is not entirely curvilinear. That is, at least a portion of the path that hermetic seal 312 extends along may be a linear segment 604, as in the case of a square path having four linear sides. A volume of acoustic cavity 314 may be defined by the rectangular area radially inward of hermetic seal 312, multiplied by a thickness of hermetic seal 312. Thus, the volume may be controlled by changing the profile or thickness of hermetic seal 312.

Figure 6C:
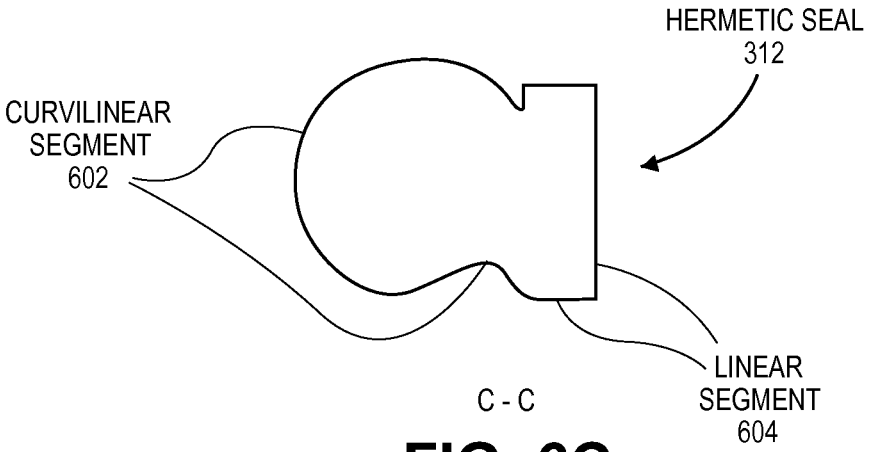

Referring to FIG. 6C, a cross-sectional view, taken about line C-C of FIG. 5, of a hermetic seal between a loudspeaker and a main logic board is shown in accordance with an embodiment. In an embodiment, hermetic seal 312 extends along a closed path that includes a combination of linear and curvilinear segments 602, 604. For example, hermetic seal 312 may include several linear segments 604 connected at corners. Furthermore, a curvilinear segment 602 may be connected to an end of at least one of the linear segments 604, and may traverse a distance that creates a closed path for hermetic seal 312. The seal paths illustrated in FIGS. 6A-6C are provided by way of example, and a variety of different paths having linear and/or curvilinear segments 602, 604 may be contemplated within the scope of this description. For example, hermetic seal 312 may extend over an open path, such as a c-shaped path, and a volume within hermetic seal 312 may be acoustically coupled with another cavity located in lateral space 318 of system housing 102 through the discontinuity in the c-shape.

Figure 7:
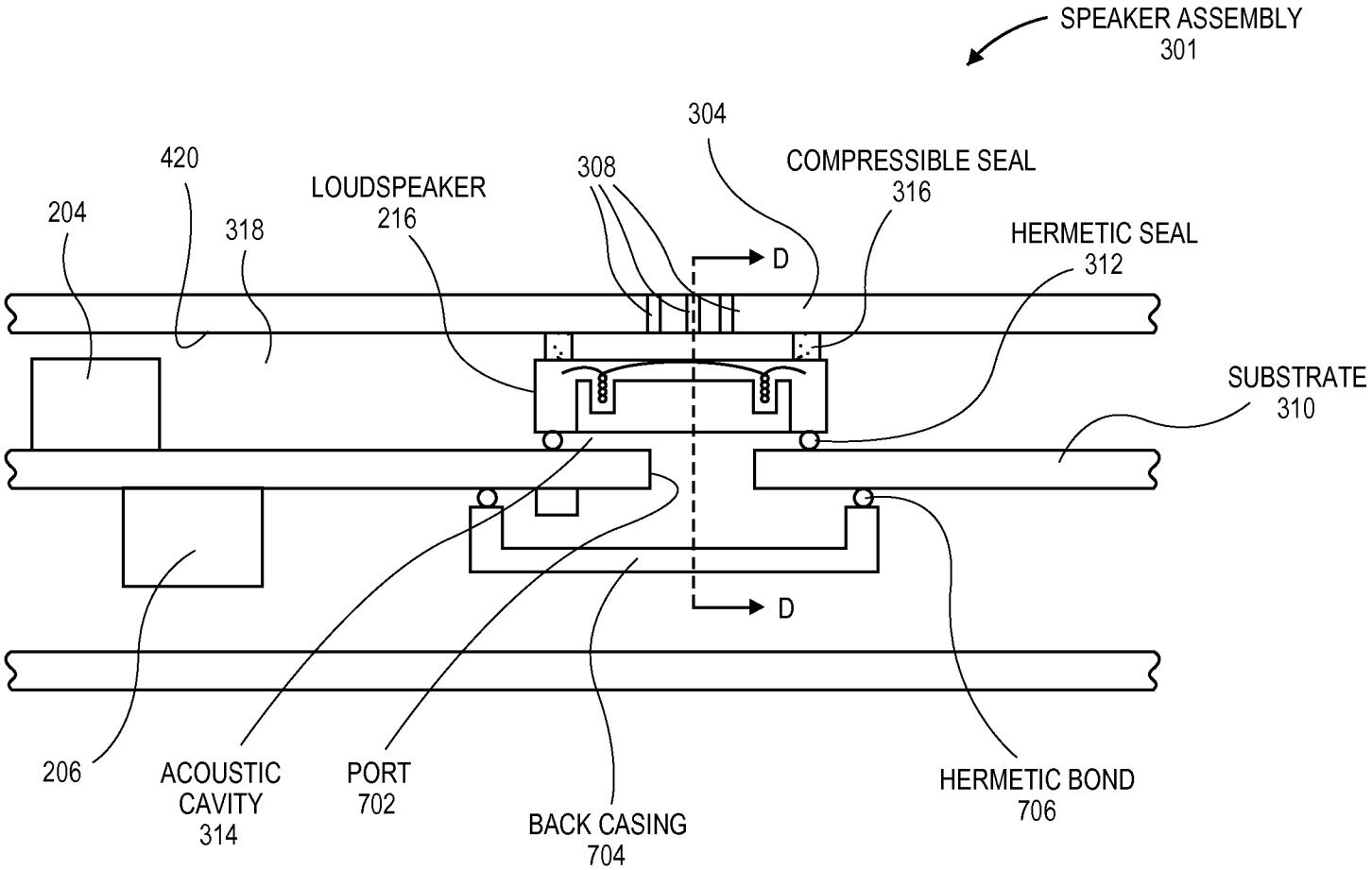
FIG. 7 is a cross-sectional view, taken about line A-A of FIG. 1, of a speaker assembly of a computer system in accordance with an embodiment.

Referring to FIG. 7, a cross-sectional view, taken about line A-A of FIG. 1, of a speaker assembly of a computer system is shown in accordance with an embodiment. Computer system 101 may include speaker assembly 301 having loudspeaker 216 mounted directly on substrate 310 of main logic board 302 over a port 702. Port 702 may be one or more holes or slots formed through substrate 310 of main logic board 302. For example, port 702 may be drilled, etched, or otherwise incorporated in main logic board 302. Thus, when loudspeaker 216 is connected to main logic board 302 by hermetic seal 312, acoustic cavity 314 formed behind loudspeaker 216 may be acoustically coupled with a space below main logic board 302 through port 702.

In an embodiment, the space below main logic board 302 may occupy an enclosed volume of a back casing 704. More particularly, back casing 704 may be mounted on an underside of substrate 310 by, e.g., a hermetic bond 706. Hermetic bond 706 may have characteristics similar to hermetic seal 312, e.g., may be an airtight joint and include a solder and/or adhesive bond. Nonetheless, different terms are used here to refer to hermetic seal 312 and hermetic bond 706 to avoid confusion between the structures. Accordingly, a back volume of loudspeaker 216 may be enclosed between loudspeaker 216, hermetic seal 312, a top surface and a bottom surface of substrate 310, hermetic bond 706, and back casing 704.

As described above, a volume may be enclosed above loudspeaker 216 by compressible seal 316 that extends between loudspeaker 216 and a bottom surface 420 of top case 304. Thus, sound generated by loudspeaker 216 may be directed toward openings 308 into the surrounding environment without propagating into lateral space 318 within system housing 102. In an embodiment, other system components and devices such as processor 204 or volatile memory 206 may be mounted on main logic board 302 within lateral space 318. In an embodiment, the components are mounted on different sides of main logic board 302, e.g., processor 204 is mounted on top of main logic board 302 and memory 206 is mounted on an underside of main logic board 302. In other embodiments, the components may occupy space on the same side of substrate 310.

Figure 8:
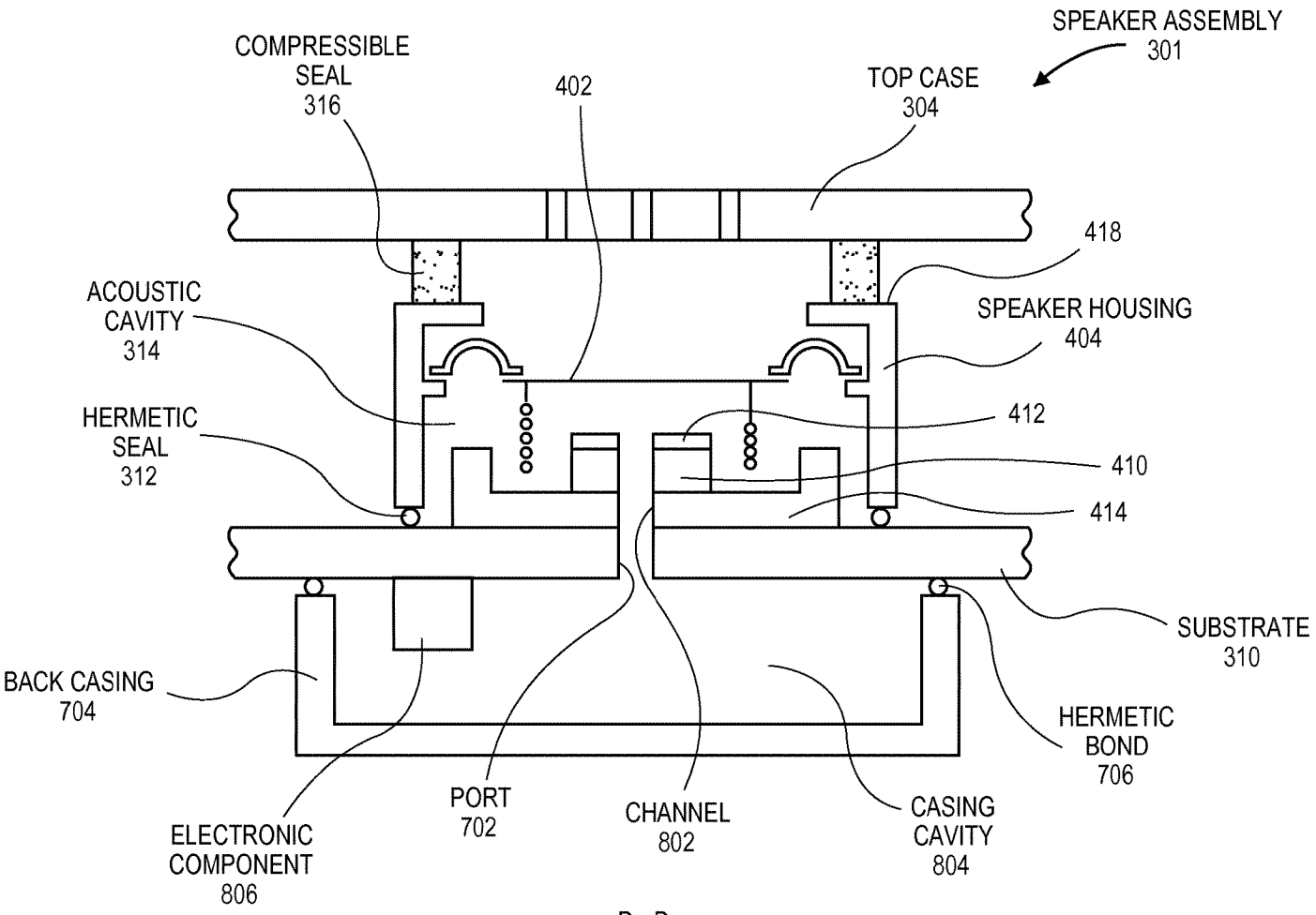
FIG. 8 is a cross-sectional view, taken about line D-D of FIG. 7, of a loudspeaker mounted over a main logic board and a back casing mounted below the main logic board in accordance with an embodiment.

Referring to FIG. 8, a cross-sectional view, taken about line D-D of FIG. 7, of a loudspeaker mounted over a main logic board and a back casing mounted below the main logic board is shown in accordance with an embodiment. In an embodiment, speaker assembly 301 includes loudspeaker 216 sandwiched between top case 304 of system housing 102 and substrate 310 of main logic board 302, above port 702 formed through substrate 310. Compressible seal 316 may fill a gap between top surface 418 of speaker housing 404 and top case 304, and hermetic seal 312 may fill a gap between a bottom surface of speaker housing 404 and a top surface of substrate 310. Thus, compressible seal 316 may be separated from hermetic seal 312 by speaker housing 404.

The magnetic structure of loudspeaker 216 may be elevated relative to substrate 310, e.g., by mounting the magnetic structure to a frame that is spaced above substrate 310. Alternatively, the magnetic structure may be mounted directly on substrate 310. For example, yoke 414 may contact substrate 310 and/or be connected to substrate 310 by an adhesive or solder bond, or another mechanical connector. A channel 802 may be provided through magnetic structure to allow for acoustic cavity 314 below diaphragm 402 to be acoustically coupled with port 702. Similarly, acoustic cavity 314 may be acoustically coupled with casing cavity 804 inside back casing 704 through channel 802 and port 702. Channel 802 may include one or more holes or slots formed through magnetic structure. For example, the holes or slots may be drilled, etched, or otherwise formed through one or more of top plate 412, permanent magnet 410, and yoke 414. Thus, an acoustic passage formed in the magnetic structure may be aligned, e.g., concentrically, with an acoustic passage in main logic board 302 to interconnect acoustic cavity 314 with casing cavity 804. Accordingly, a multi-chamber back volume may be formed in speaker assembly 301, and in an embodiment, an outer boundary of speaker assembly 301 encompasses a front volume and a back volume defined between top case 304, compressible seal 316, speaker housing 404, hermetic seal 312, substrate 310, hermetic bond 706, and back casing 704.

A multi-chamber back volume may include space above and below substrate 310. For example, back volume may include the volume of acoustic cavity 314 defined between diaphragm 402, surround 406, speaker housing 404, hermetic seal 312, a top surface of substrate 310, and/or magnetic structure. Back volume may also include the volume of casing cavity 804 defined between a bottom surface of substrate 310, hermetic bond 706, and/or back casing 704. In an embodiment, back volume includes the volumes within channel 802 and port 702 extending between acoustic cavity 314 and casing cavity 804. Thus, in an embodiment, a back volume incorporating space above and below substrate 310 utilizes more of the vertical height between top case 304 and bottom case 306 than an embodiment in which back volume resides only above or below substrate 310. Increasing back volume may improve low frequency output, and thus, mounting loudspeaker 216 directly to main logic board 302 such that a multi-chamber back volume is integrated within airtight joints of the assembly may improve sound output and sound quality.

In addition to increasing speaker back volume, the chambers of speaker assembly 301 may provide shielding to other system components. As described above, main logic board 302 may incorporate components on a top side and a bottom side. For example, processor 204 may be mounted on the top side of main logic board 302 and memory may be mounted on the bottom side of main logic board 302, or vice versa. Other components, such as passives, DRAM, etc., may be mounted on either side of main logic board 302, and in some cases, may be mounted adjacent to loudspeaker 216. For example, an electronic device or electronic component 806, such as a capacitor, may be mounted on substrate 310 below loudspeaker 216. In an embodiment, electronic component 806 may be located within casing cavity 804 such that back casing 704 shields electronic components, e.g., acoustically or electrically.

In an embodiment, back casing 704 acoustically shields electronic component 806 mounted on main logic board 302 within casing cavity 804 of the back volume. Back casing 704 may be formed from a material that attenuates sound waves generated by electronic component 806. For example, back casing 704 may include a plastic shell having a thickness on the order of 1 mm. In an embodiment, a layer of acoustic foam may cover at least a portion of an inside or outside surface of back casing 704 to provide further acoustic shielding of electronic component 806. Thus, sound generated by electronic component 806 during operation, e.g., due to vibration of the electronic component 806 during operation, may be shielded to reduce noise. Accordingly, a multi-chamber back volume can improve sound output of speaker assembly 301 and reduce noise emission from computer system 101. In an embodiment, if system noise arises from or is contributed to by substrate vibration, the substrate that defines a portion of the multi-chamber back volume may be stiffened to further augment noise reduction.

In an embodiment, back casing 704 electrically shields electronic component 806 mounted to main logic board 302 within casing cavity 804 of the back volume. Back casing 704 may include a metal shell, e.g., sheet metal, metal screen, or metal foam, having a thickness on the order of 0.5 mm to 5 mm, and in some cases 1 mm. Thus, back casing 704 may provide electromagnetic shielding of electronic component 806 by reducing the electromagnetic field within casing cavity 804. Such shielding can isolate the electronic component 806 from radiation that may negatively impact system performance. Accordingly, a multi-chamber back volume can improve sound output of speaker assembly 301 and performance of computer system 101.

Figure 9:
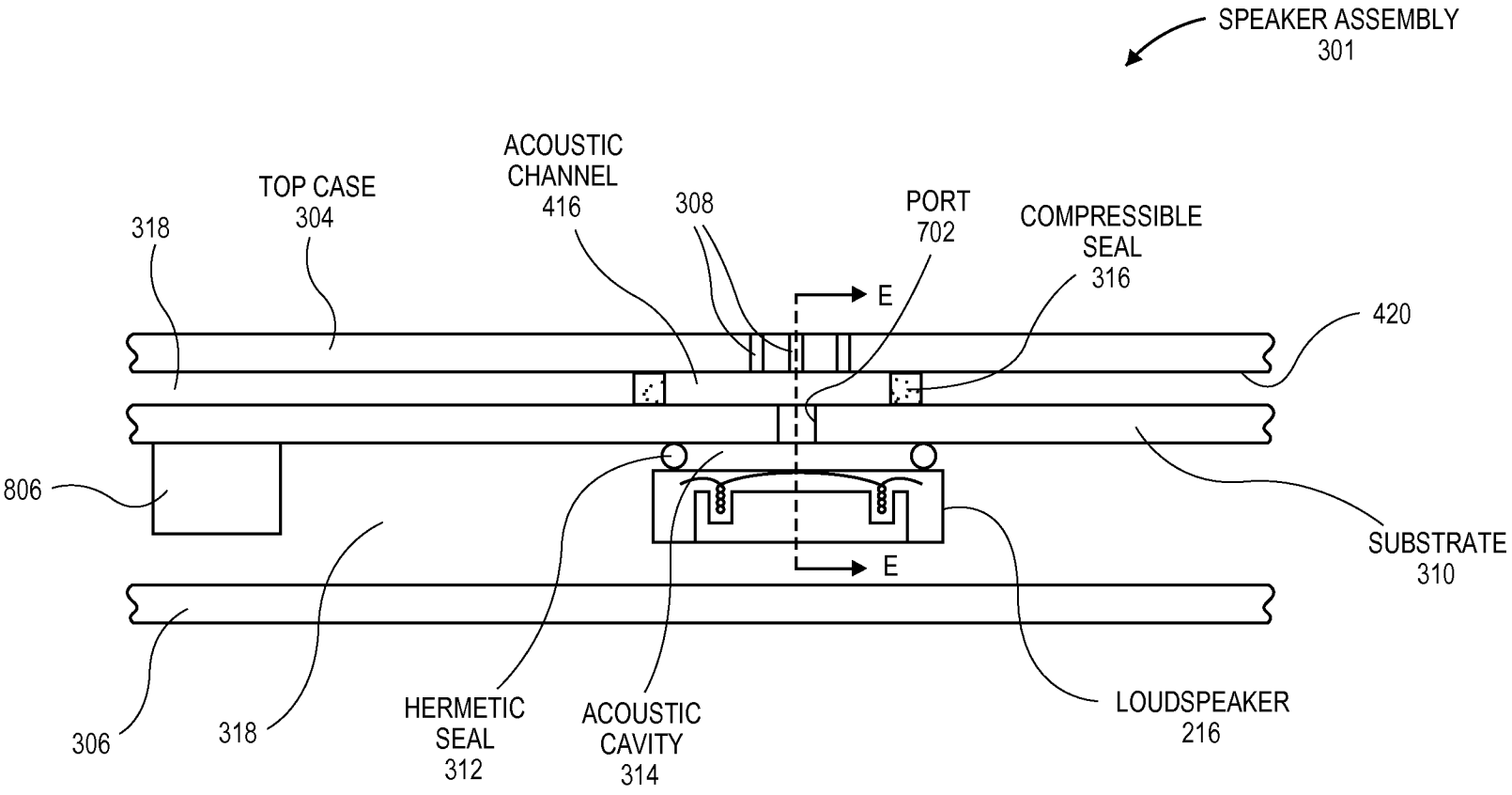
FIG. 9 is a cross-sectional view, taken about line A-A of FIG. 1, of a speaker assembly of a computer system in accordance with an embodiment.

Referring to FIG. 9, a cross-sectional view, taken about line A-A of FIG. 1, of a speaker assembly of a computer system is shown in accordance with an embodiment. In an embodiment, speaker assembly 301 includes loudspeaker 216 mounted on a bottom surface of main logic board 302. For example, loudspeaker 216 may be bonded to substrate 310 by hermetic seal 312 between a top surface 418 of loudspeaker 216 and a bottom surface of substrate 310. Thus, loudspeaker 216 may be located between substrate 310 and bottom case 306. Loudspeaker 216 may share the bottom surface of substrate 310 with other system components, such as electronic component 806, e.g., processor 204 or memory 206.

In an embodiment, loudspeaker 216 may emit sound upward toward openings 308 of top case 304 through port 702 formed in substrate 310. More particularly, sound may be directed forward into openings 308 by compressible seal 316, which is sandwiched between a top surface of substrate 310 and a bottom surface 420 of top case 304. Since compressible seal 316 may be between substrate 310 and top case 304, while hermetic seal 312 may be between substrate 310 and bottom case 306, compressible seal 316 and hermetic seal 312 may be separated by substrate 310 of main logic board 302. Compressible seal 316 may be acoustically rigid to create acoustic channel 416 that directs sound forward toward the surrounding environment. That is, compressible seal 316 and hermetic seal 312 may prevent sound transmission into lateral space 318 of system housing 102. Thus, in an embodiment, port 702 interconnects acoustic channel 416, which forms a first portion of a front volume of speaker assembly 301, with acoustic cavity 314 above loudspeaker 216, which forms a second portion of the front volume of speaker assembly 301.

Figure 10:
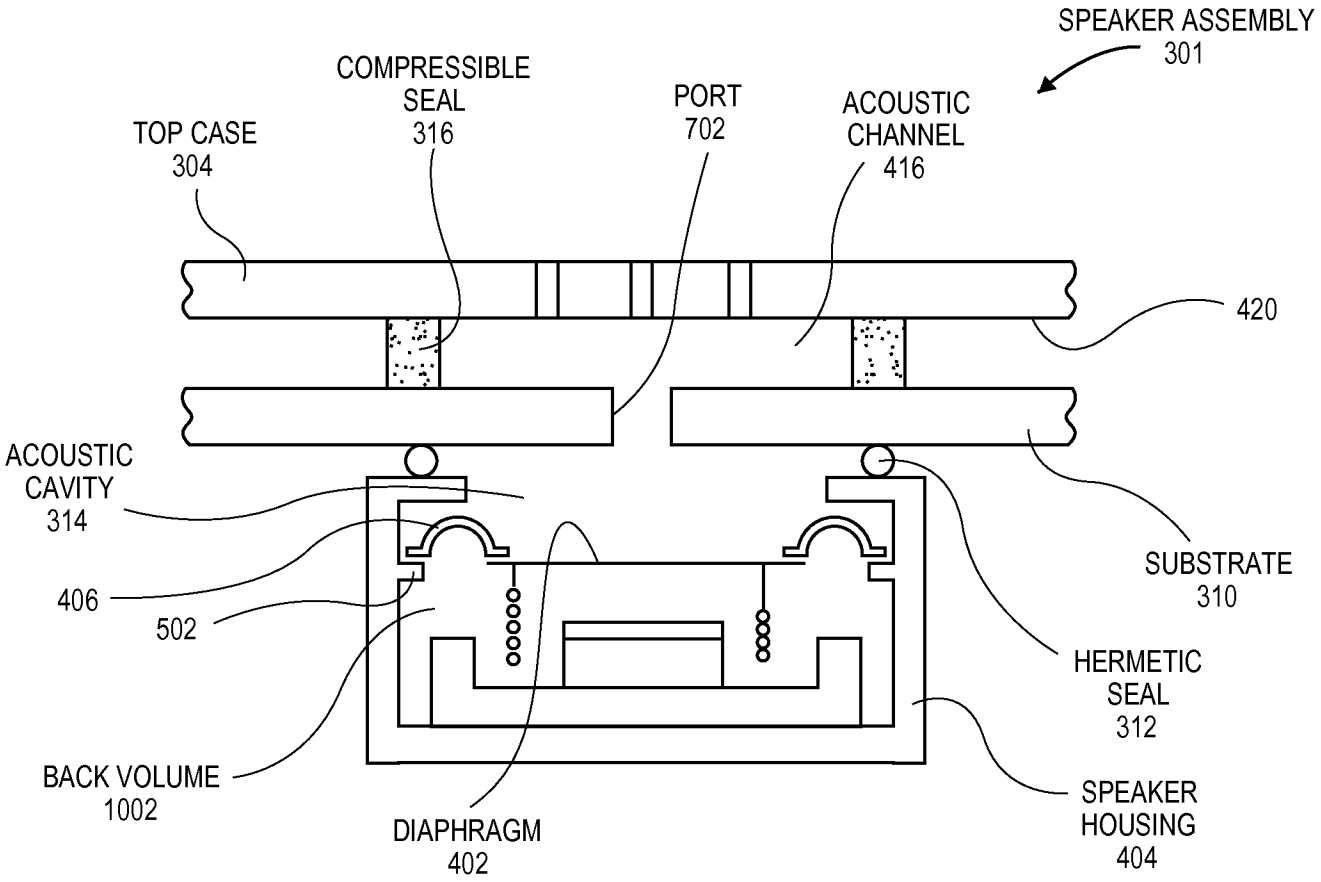
FIG. 10 is a cross-sectional view, taken about line E-E of FIG. 9, of a loudspeaker mounted under a main logic board in accordance with an embodiment.

Referring to FIG. 10, a cross-sectional view, taken about line E-E of FIG. 9, of a loudspeaker mounted under a main logic board is shown in accordance with an embodiment. Speaker assembly 301 may include a multi-chamber front volume that includes acoustic channel 416 and acoustic cavity 314. As described above, acoustic cavity 314 may include that portion of the front volume that is defined radially inward from hermetic seal 312, which bonds speaker housing 404 to substrate 310. More particularly, acoustic cavity 314 may be defined between diaphragm 402, surround 406, speaker housing 404, hermetic seal 312, and a bottom surface of substrate 310. As described above, acoustic channel 416 may include that portion of the front volume that is defined radially inward from compressible seal 316. More particularly, acoustic channel 416 may be defined between a bottom surface 420 of top case 304, compressible seal 316, and a top surface of substrate 310. Front volume may also include the space within port 702, which acoustically couples acoustic channel 416 with acoustic cavity 314. Thus, front volume may incorporate multiple chambers that include that portion of speaker assembly 301 above diaphragm 402, and furthermore, may include acoustic cavity 314. Accordingly, in an embodiment, a back volume 1002 of speaker assembly 301 may be separated from acoustic cavity 314 by diaphragm 402.

Back volume 1002 may include the space behind diaphragm 402 of loudspeaker 216, within speaker housing 404. For example, speaker housing 404 may include a fully enclosed box, enclosure, can, etc., which connects with speaker surround 406 along lip 502 to create a space within which motor assembly may be housed. In this way, back volume shape and size may be closely defined during the formation of speaker housing 404 to control the low frequency output of speaker assembly 301. Also, since back volume 1002 may be located opposite of diaphragm 402 from substrate 310, main logic board 302 may form a wall of the front volume of speaker assembly 301, rather than a wall of back volume 1002. As in several of the embodiments above, an outer boundary of speaker assembly 301 may be defined between top case 304, compressible seal 316, substrate 310, hermetic seal 312, and speaker housing 404.

In the above embodiments, port 702 and/or channel 802 may be sized to limit the resistance to particle flow through a front volume and/or a back volume of speaker assembly 301. For example, in the case of port 702 or channel 802 in any of the embodiments shown in, e.g., FIG. 8 or FIG. 10, the size of a via or passage extending through substrate 310 and/or magnetic structure may be sized such that acoustic resistance is provided to the driver to mitigate acoustic resonances. In an embodiment, the via or passage size may be at least one-tenth of the size of openings 308 that vent sound to the surrounding environment. That is, a total cross-sectional area of openings 308 may be less than ten times a total cross-sectional area of port 702 and/or channel 802. Total cross-sectional area of any of these passages may be a cumulative cross-sectional area. For example, just as multiple openings 308 may be formed through top case 304, a grouping of ports 702 and/or channels 802 may be provided to place different chambers of speaker assembly 301 in fluid communication through, e.g., substrate 310 (to acoustically couple the chambers). For example, manufacturability considerations may favor forming port 702 as several small through-holes, rather than as a single large through-hole. That is, five small holes may be drilled through substrate 310 to form port 702 with the same cumulative cross-sectional area as a single hole. In any case, the size and shape of the holes (including whether the holes are cylindrical, frustoconical, etc.), may be chosen to acoustically tune the holes to limit resistance to particle flow and to suppress cavity modes in speaker assembly 301.

Figure 11:
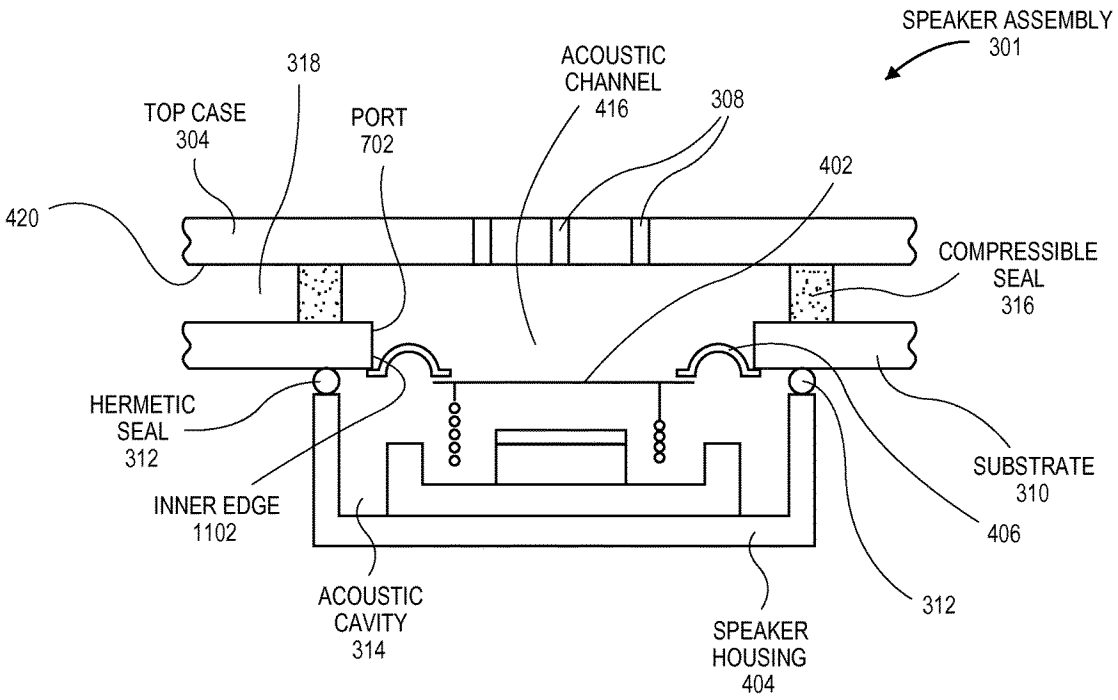
FIG. 11 is a sectional view of a loudspeaker integrated with a main logic board in accordance with an embodiment.

Referring to FIG. 11, a sectional view of a loudspeaker integrated with a main logic board is shown in accordance with an embodiment. In an embodiment, speaker assembly 301 includes loudspeaker 216 integrated directly with main logic board 302. For example, a portion of substrate 310 of main logic board 302 may interconnect diaphragm 402 and speaker surround 406 with speaker housing 404. Port 702 may be formed through substrate 310 such that an inner edge 1102 is created along a perimeter of port 702. Inner edge 1102 may enclose the cross-sectional area of port 702. Thus, by bonding speaker surround 406 to inner edge 1102, diaphragm 402 may extend across the lateral distance between opposite sides of inner edge 1102 to cover port 702. That is, diaphragm 402 may be movably connected with inner edge 1102 through speaker surround 406, which flexes to allow diaphragm 402 to move pistonically relative to substrate 310. Accordingly, sound generated by the movement of diaphragm 402 may be emitted directly into port 702 toward acoustic channel 416 and openings 308.

In an embodiment in which loudspeaker 216 is integrated with main logic board 302, compressible seal 316 is sandwiched between top case 304 and substrate 310 to form acoustic channel 416. More particularly, compressible seal 316 may fill a gap between top case 304 and substrate 310 to limit or prevent leakage into lateral space 318 of system housing 102. In an embodiment, compressible seal 316 includes an acoustically rigid material extending along an annular path to form acoustic channel 416 leading to openings 308 in top case 304. Port 702 may be radially inward from compressible seal 316 such that sound passing through port 702 is delivered into acoustic channel 416 and forward through openings 308. Alternatively, as described above, compressible seal 316 may have a side port, e.g., a break in a c-shape, such that sound entering a space within compressible seal 316 from port 702 is vented laterally between top case 304 and substrate 310 through a side-firing opening to the surrounding environment.

In an embodiment, speaker housing 404 is joined with a bottom side of substrate 310 by hermetic seal 312. For example, hermetic seal 312 may bond an upper surface of speaker housing 404 with a bottom surface of substrate 310 along a closed path that is radially outward from inner edge 1102. That is, the closed path may encompass port 702. Accordingly, substrate 310 may separate compressible seal 316 from hermetic seal 312 in an axial direction. Furthermore, substrate 310 may separate inner edge 1102 from hermetic seal 312 in a radial direction. As such, an acoustic cavity 314 of the integrated loudspeaker may be defined between diaphragm 402, surround 406, a bottom surface of substrate 310, hermetic seal 312, speaker housing 404, and the magnetic structure. Acoustic cavity 314 may form the entire back volume of speaker assembly 301 below diaphragm 402, and thus, speaker housing 404 may be sized and shaped to provide a desired low frequency output. By contrast, front volume may be defined above diaphragm 402 and between diaphragm 402, speaker surround 406, port 702, a top surface of substrate 310, compressible seal 316, and/or a bottom surface 420 of top case 304.

As described above, speaker assembly 301 may include loudspeaker 216 mounted directly on substrate 310 by hermetic seal 312 to provide an acoustic cavity 314 above and/or below the substrate 310 in a space efficient and acoustically viable configuration. As a result, speaker assembly 301 may be integrated within the footprint of main logic board 302 to free up space around main logic board 302 for other system components, without degrading sound quality of computer system 101. That is, speaker assembly 301 may have an outer boundary defined by top case 304, compressible seal 316, substrate 310, hermetic seal 312, and speaker housing 404. It will be appreciated that the various features used to realize this configuration, e.g., an airtight seal along a closed path between a loudspeaker 216 and a main logic board 302, a back volume and/or front volume split into multiple chambers on opposite sides of a main logic board 302, or an acoustically rigid seal separated from the airtight seal to direct sound toward a system exit 104, can be implemented in various other embodiments to result in a compact consumer electronics product having good sound quality.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A computer system, comprising:

a top case having one or more openings;

a main logic board below the top case, the main logic board having a substrate coupled with a processor and a memory; and a loudspeaker having a diaphragm movably connected with a speaker housing, wherein the diaphragm is configured to emit sound axially toward the one or more openings, and wherein the speaker housing is bonded to the substrate to form a hermetic joint extending axially between a bottom surface of the speaker housing and the substrate, and traversing a closed path around an acoustic cavity defined between the diaphragm, the speaker housing, the hermetic joint, and the substrate.

2. The computer system of claim 1, wherein the hermetic joint comprises a solder joint.

3. The computer system of claim 1, wherein the hermetic joint comprises a non-conductive adhesive joint.

4. The computer system of claim 1 further comprising a compressible seal between the loudspeaker and the top case, wherein the speaker housing separates the compressible seal from the hermetic joint, and wherein the compressible seal defines an acoustic channel extending between the diaphragm and the one or more openings.

5. The computer system of claim 4, wherein the compressible seal extends from the substrate to the top case.

6. The computer system of claim 4, wherein the compressible seal extends from a top surface of the speaker housing to the top case.

7. The computer system of claim 4 further comprising one or more acoustic ports formed through the substrate and located radially inward from the hermetic joint.

8. The computer system of claim 7, wherein the one or more openings in the top case have a first cumulative cross-sectional area, wherein the one or more ports through the substrate have a second cumulative cross-sectional area, and wherein the first cumulative cross-sectional area is less than ten times the second cumulative cross-sectional area.

9. The computer system of claim 8 further comprising a back casing below the one or more ports, wherein the back casing is coupled with the substrate such that a casing cavity is defined between the back casing and the substrate.

10. The computer system of claim 9, wherein the acoustic cavity is acoustically coupled with the casing cavity through the one or more ports.

11. The computer system of claim 10, wherein a back volume of the loudspeaker includes the acoustic cavity above the substrate and the casing cavity below the substrate.

12. The computer system of claim 11, wherein the loudspeaker includes a magnetic structure above the substrate in the acoustic cavity, and wherein the magnetic structure includes a channel extending from the acoustic cavity to the one or more ports.

13. The computer system of claim 12, wherein the magnetic structure includes a stack having a top plate, a permanent magnet, and a yoke, and wherein the channel extends through the stack.

14. The computer system of claim 13 further comprising one or more devices mounted to the substrate in the casing cavity, wherein the back casing is configured to shield the one or more devices.

15. The computer system of claim 7, wherein the diaphragm is movably connected with the substrate directly, such that a surround of the loudspeaker is directly attached to the substrate.

16. The computer system of claim 7, wherein a front volume of the loudspeaker includes the acoustic channel above the substrate and the acoustic cavity below the substrate.

17. The computer system of claim 4, wherein the diaphragm is movably connected with a first edge of the speaker housing at a first location and a second edge of the speaker housing is connected with the substrate by the hermetic joint at a second location radially outward from the first location.

18. A computer system comprising:

an external housing having a top face and a bottom face, the top face having a sound output opening formed therein;

a circuit board within the external housing, the circuit board having a plurality of electronic hardware components installed on a circuit carrier;

a loudspeaker bonded to the circuit carrier, the loudspeaker having a speaker housing, a diaphragm that movably connects to the speaker housing and is acoustically coupled to the sound output opening in the top face of the external housing through an acoustic channel that is part of a front volume of the loudspeaker; and a hermetic joint that seals a gap between the speaker housing and the circuit carrier to create an acoustic cavity defined by the diaphragm, the speaker housing, the hermetic joint, and the circuit carrier, the acoustic cavity being part of a back volume of the loudspeaker, wherein the hermetic joint extends axially between a bottom surface of the speaker housing and the circuit carrier, and traversing a closed path around the acoustic cavity.

19. A computer system, comprising:

a system housing having a ceiling, a floor, and an internal volume between the ceiling and the floor;

a circuit board in the internal volume, the circuit board having a substrate coupled with a processor and a memory; and a loudspeaker having a diaphragm movably connected with a speaker housing, wherein the loudspeaker divides the internal volume into a front volume between the ceiling and the diaphragm and a back volume between the floor and the diaphragm, wherein the speaker housing is coupled with the ceiling by a compressible seal that defines an acoustic channel in the front volume between the diaphragm and the ceiling, and wherein the speaker housing is bonded to the substrate to form a hermetic joint extending axially between a bottom surface of the speaker housing and the substrate, and traversing a closed path around an acoustic cavity in the back volume between the diaphragm and the floor.

20. The computer system of claim 19, wherein the speaker housing is shaped such that the acoustic cavity is a desired volume between the diaphragm, the speaker housing, the hermetic joint, and the substrate.

* * * * *